United States Patent [19]

Scott et al.

[11] Patent Number: 4,591,390

[45] Date of Patent: May 27, 1986

[54] CABLE CLEANING SYSTEM

[75] Inventors: John E. Scott, London; Harold Griffiths, Hereford, both of England

[73] Assignee: Shell Internationale Research Maatschappij B. V., Netherlands

[21] Appl. No.: 336,925

[22] Filed: Jan. 4, 1982

[30] Foreign Application Priority Data

Mar. 25, 1981 [GB] United Kingdom ..... 8109409

[51] Int. Cl.[4] ..... B08B 1/02

[52] U.S. Cl. ..... 134/15; 134/21; 15/302; 15/306 A

[58] Field of Search ..... 15/302, 306 A, 353; 134/15, 21

[56] References Cited

U.S. PATENT DOCUMENTS

| | | | |
|---|---|---|---|
| 3,530,526 | 9/1970 | Schmidt | 15/302 |
| 3,705,437 | 12/1972 | Rukavina et al. | 15/302 |
| 3,736,618 | 6/1973 | Ramsey | 15/306 A |
| 3,775,053 | 11/1973 | Wisdom | 15/302 X |
| 4,025,984 | 5/1977 | Hoener | 15/302 |
| 4,136,419 | 1/1979 | Hetman et al. | 15/302 |

FOREIGN PATENT DOCUMENTS

| | | |
|---|---|---|
| 1466677 | 3/1977 | United Kingdom . |
| 1526952 | 10/1978 | United Kingdom . |

*Primary Examiner*—Benoît Castel

*Attorney, Agent, or Firm*—Pravel, Gambrell, Hewitt & Kimball

[57] ABSTRACT

The invention relates to a cable cleaning and lubricating system comprising a chamber (5) adapted to surround a section of a cable (4) to be cleaned and to be displaced relative to the cable (4), nozzles (7) within the chamber (5) for directing jets of relatively high pressure cleaning liquid onto the surface of the cable (4), sealing means (6) at both ends of the chamber (5) and adapted to contact the cable (4), the chamber (5) being provided with an outlet (10) which is in communication with a vacuum pump for reducing the pressure in the chamber (5) to a value below atmospheric pressure. The invention relates furthermore to the use of this system for cleaning and lubricating a cable (FIG. 1).

2 Claims, 2 Drawing Figures

CABLE CLEANING SYSTEM

FIELD OF THE INVENTION

The present invention relates to a cable cleaning system and to a method of cleaning a cable by means of such a system.

BACKGROUND OF THE INVENTION

Cable cleaning systems for cleaning cables are known, for example from British Patent Specification No. 1,466,677, published on Mar. 9th, 1977, and from British Patent Specification No. 1,526,952, published on Oct. 4th, 1978.

Said known cable cleaning systems comprise a chamber adapted to surround a section of a cable to be cleaned and to be displaced relative to the cable, nozzles within the chamber for directing jets of high pressure cleaning liquid onto the surface of the cable, sealing means at both ends of the chamber and adapted to contact the cable and means for withdrawing used cleaning liquid with dirt and other matter entrained therein from the chamber.

During operation of said known cable cleaning systems, the used cleaning liquid is withdrawn from the chamber by means of a conventional liquid sludge pump and is passed through a conduit to a tank for collecting used cleaning liquid.

A problem with the known cable cleaning systems is the leakage of used cleaning liquid from the chamber along the sealing means contacting the cable. This problem is particularly serious when the cable cleaning system is used for cleaning stranded wire rope, which has an outer surface which is far from smooth.

Such leakage of used cleaning liquid from the chamber means a loss of the used cleaning liquid, which is not economical since the used cleaning liquid is still of such a quality that it could be regenerated and be recirculated to be used again for cleaning the cable.

It is the object of the invention to provide an improved cable cleaning system and a method of cleaning a cable by means of the said improved cable cleaning system, having the advantage that leakage of used cleaning liquid from the chamber along the sealing means contacting the cable is eliminated.

SUMMARY OF THE INVENTION

According to the present invention there is provided a cable cleaning system comprising a chamber adapted to surround a section of a cable to be cleaned and to be displaced relative to the cable, nozzles within the chamber for directing jets of relatively high pressure cleaning liquid onto the surface of the cable, sealing means at both ends of the chamber and adapted to contact the cable, the chamber being provided with an outlet which is in communication with a vacuum pump for reducing the pressure in the chamber to a value below atmospheric pressure.

An attractive embodiment of the cable cleaning system according to the invention comprises a conduit connecting the outlet to a tank for collecting used cleaning liquid, wherein the vacuum pump is in communication with the vapour space of the tank for reducing the pressure in the tank to a value below atmospheric pressure.

The method of cleaning a cable by means of the above cable cleaning system comprises, according to the invention, displacing the chamber relative to the cable, passing cleaning liquid of relatively high pressure to the nozzles in order to direct jets of relatively high pressure cleaning liquid onto the surface of the cable, and operating the vacuum pump so as to cause a reduction of the pressure in the chamber to a value below atmospheric pressure and a flow of air from the surroundings along the sealing means and into the chamber.

Preferably the method according to the invention comprises operating the vacuum pump so as to cause a reduction of pressure to a value below atmospheric pressure in the tank for collecting used cleaning liquid and in the chamber.

Since, during operation of the cable cleaning system, the pressure in the chamber is always maintained at a pressure below atmospheric pressure, air will flow from the surroundings along the sealing means contacting the cable and into the chamber. This flow of air into the chamber will effectively prevent any leakage of cleaning liquid from the chamber.

BRIEF DESCRIPTION OF THE DRAWINGS

The invention will be explained with reference to the drawings, wherein.

DETAILED DESCRIPTION OF THE INVENTION

Figure 1:
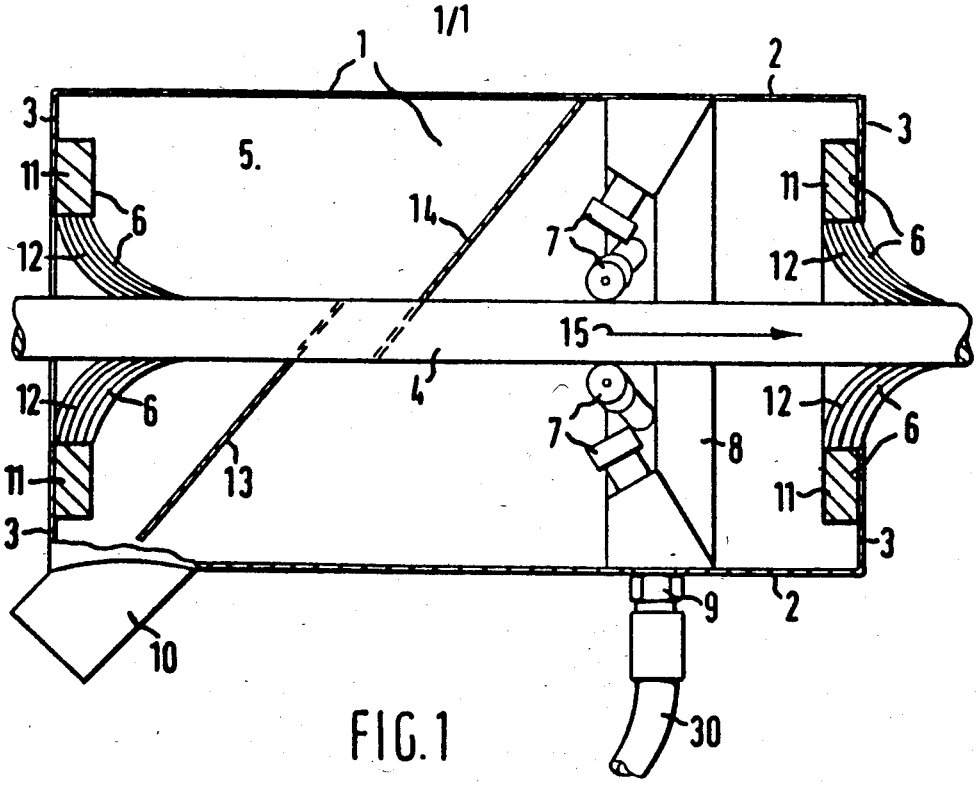
FIG. 1 shows a longitudinal cross-section of a cleaning device.

The cleaning device 1 comprises a cylindrical wall 2 provided with end walls 3 which form a hollow cylindrical body enclosing a chamber 5. The cylindrical body is divided into two halves so that it can be fitted around a cable 4 which is to be cleaned. Each end wall 3 is provided with an annular sealing element 6 surrounding and contacting the cable 4. Each sealing element 6 comprises preferably an annular element 11 carrying bristles 12, which are radially arranged in the annular element 11, so that an annular brush is formed contacting the cable 4. A plurality of nozzles 7, for example six or twelve, is arranged in the chamber 5 for directing jets of high pressure cleaning liquid onto the cable 4 at an angle to the cable axis. The nozzles 7 are in communication with a ring main 8, which is provided with an inlet 9. A supply line 30 for the supply of cleaning liquid is connected to the inlet 9. Furthermore, the chamber 5 is provided with an outlet 10. Staggered baffles 13 and 14 are arranged in the chamber 5 to direct the spray of cleaning liquid, together with the material removed from the cable 4, towards the outlet 10. The outlet 10 is in communication with a vacuum pump, which will be explained with reference to FIG. 2.

Figure 2:
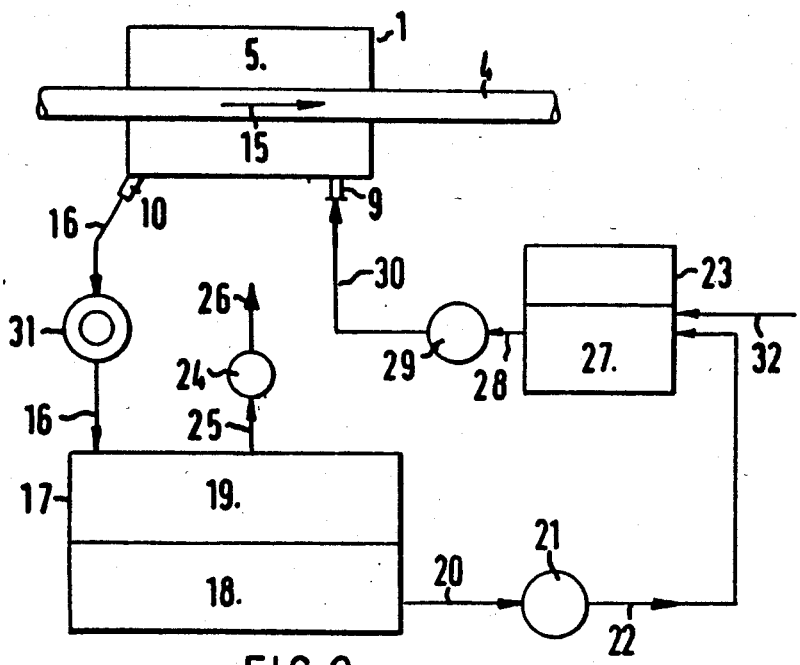
FIG. 2 shows schematically the arrangement of the cleaning device in the cleaning system.

In FIG. 2, the outlet 10 is connected by means of a conduit 16 via a centrifuge 31 to a tank 17 for collecting "used" filtered cleaning liquid. In the centrifuge 31 dirt and water is removed from the cleaning liquid, whereafter the cleaning liquid is passed to the tank 17. "Used" cleaning liquid present in tank 17 is indicated by reference numeral 18, whereas the vapour space in the tank is indicated by reference numeral 19. A suction line 20 connects a liquid pump 21 to the tank 17 as shown. The delivery side of the pump 21 is connected to a tank 23 for collecting "new" cleaning liquid by means of a supply line 22. The "new" cleaning liquid present in the tank 23 is indicated by the reference numeral 27. A suction line 28 connects a high pressure pump 29 to the tank 23. The delivery side of the pump 29 is connected to the inlet 9 by means of the supply line 30. The tank is provided with a supply line 32 for supplying extra cleaning liquid to the tank 23 in order to replace cleaning liquid lost during the cable cleaning operation. A vacuum pump 24 is connected to the vapour space 19 of the tank 17 by means of a suction line 25. The vacuum pump 24 is provided with an exhaust 26.

The operation of the cable cleaning system according to the invention will now be explained with reference to FIGS. 1 and 2.

After the cable cleaning device 1 has been mounted on the cable 4, the device 1 and the cable 4 are displaced relative to each other. In the present example, the device 1 is stationary and the cable 4 is displaced relative to the device 1 in the direction indicated by the arrow 15. During this diplacement of the cable 4, cleaning and lubricating liquid, preferably a suitable oil, is supplied from tank 27 through suction line 28, pump 29, supply line 30, inlet 9 and ring main 8 to the nozzles 7. The nozzles 7 direct jets of high pressure cleaning and lubricating liquid onto the surface of the cable 4 for cleaning the cable. At the same time the vacuum pump 24 is operating, so that the pressure in the tank 17 is reduced to a value below atmospheric pressure. This reduction of pressure in the tank 17 propagates through the conduit 16 and the outlet 10 to the chamber 5, so that the pressure in the chamber 5 will be reduced as well to a value below atmospheric pressure.

The fact that the pressure in the chamber 5 is maintained at a value below atmospheric pressure causes air present outside the chamber 5 to flow along the sealing elements 6 into the chamber 5. This flow of air into the chamber 5 prevents the leakage of used cleaning liquid from the chamber 5 along the sealing elements 6. This flow of air is maintained through the chamber 5 and from the chamber through outlet 10 and conduit 16 to the tank 17. Consequently the spray of cleaning liquid formed in the chamber 5 is entrained by said flow of air to the tank 17. In the centrifuge 31 the dirt removed from the cable 4 in the form of solid particles and water is separated from said cleaning liquid before it is passed to the tank 17. The spray of cleaning liquid formed is directed towards the outlet 10 by means of the baffles 13 and 14.

In the above description of the operation of the device 1, the latter is stationary and the cable 4 is displaced relative to the device 1. Instead, it is of course possible to displace the device 1 along a cable 4 which is stationary in order to clean and lubricate said cable.

The high pressure pump 29 as shown in FIG. 2 is preferably primed from a low pressure pump (not shown) situated in the suction line 28. Furthermore a strainer (not shown) is present in the suction line 28 of the high pressure pump 29 in order to protect the high pressure pump 29. A fine filter (not shown) is situated in the supply line 30 at inlet 9 for the protection of the nozzles 7.

We claim:

1. A method of cleaning and lubricating a cable by means of a cable cleaning and lubricating system of the type which includes a chamber adapted to surround a section of a cable to be cleaned and lubricated and to be displaced relative to the cable, nozzles within the chamber for directing jets of relatively high pressure cleaning and lubricating liquid onto the surface of the cable, sealing means at both ends of the chamber and adapted to contact the cable, and the chamber being provided with an outlet, which method comprises: displacing the chamber relative to the cable, passing the cleaning and lubricating liquid at a relatively high pressure to the nozzles in order to direct jets of relatively high pressure liquid onto the surface of the cable, operating a vacuum pump in communication with a vapor space of a tank for collecting used cleaning liquid and with the outlet of the chamber so as to cause a reduction of pressure in the vapor space and in the chamber to a value which is so much below atmospheric pressure that a flow of air from the surroundings along the sealing means and into the chamber is maintained, whereby any leakage of fluid from the chamber is prevented.

2. A cable cleaning and lubricating system comprising a chamber adapted to surround a section of a cable to be cleaned and lubricated and to be displaced relative to the cable, nozzles within the chamber for directing jets of relatively high pressure cleaning and lubricating liquid onto the surface of the cable, sealing means at both ends of the chamber and adapted to contact the cable, the chamber being provided with an outlet, and a conduit connecting the outlet to the vapor space of a tank for collecting the used cleaning and lubricating liquid, wherein a vacuum pump is in communication with the vapor space of the tank for reducing the pressure in the vapor space of the tank and in the chamber to a value which is so much below atmospheric pressure that, during normal operation, a flow of air from the surroundings along the sealing means and into the chamber is maintained, so that any leakage of cleaning and lubricating liquid from the chamber is prevented.

* * * * *